US006994609B1

(12) United States Patent
Gotkis

(10) Patent No.: US 6,994,609 B1
(45) Date of Patent: Feb. 7, 2006

(54) CHEMICAL MECHANICAL PLANARIZATION SYSTEM WITH REPLACEABLE PAD ASSEMBLY

(75) Inventor: Yehiel Gotkis, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/744,280

(22) Filed: Dec. 22, 2003

Related U.S. Application Data

(63) Continuation-in-part of application No. 10/025,379, filed on Dec. 18, 2001, now Pat. No. 6,729,943.

(51) Int. Cl.
*B24B 1/00* (2006.01)

(52) U.S. Cl. ..... 451/41; 451/57

(58) Field of Classification Search ..... 451/41, 451/285, 287, 288, 28, 57

See application file for complete search history.

(56) References Cited

U.S. PATENT DOCUMENTS

| | | | | |
|---|---|---|---|---|
| 5,676,590 | A * | 10/1997 | Hiraoka | 451/287 |
| 6,086,464 | A * | 7/2000 | Ulfig et al. | 451/259 |
| 6,379,221 | B1 * | 4/2002 | Kennedy et al. | 451/41 |
| 6,520,895 | B2 * | 2/2003 | Senga et al. | 483/1 |
| 2003/0114079 | A1 * | 6/2003 | Berkstresser et al. | 451/28 |

* cited by examiner

*Primary Examiner*—Dung Van Nguyen
(74) *Attorney, Agent, or Firm*—Martine Penilla & Gencarella LLP

(57) ABSTRACT

A table assembly for use in a wafer preparation module is provided. The table assembly includes a replaceable pad assembly and a permanent pad assembly. The replaceable pad assembly has a removable support element and a pad. A backside of the pad is secured to a front surface of the removable support element. The permanent support element is removeably secured to the replaceable pad assembly. A method for conducting multiple wafer preparation operations in a single processing module, a method for conducting multiple CMP operations in a single module, and a system for preparing a wafer are also provided.

13 Claims, 11 Drawing Sheets

CHEMICAL MECHANICAL PLANARIZATION SYSTEM WITH REPLACEABLE PAD ASSEMBLY

CROSS REFERENCE TO RELATED APPLICATION

This application is a continuation-in-part of U.S. patent application Ser. No. 10/025,379, filed on Dec. 18, 2001 now U.S. Pat. No. 6,729,943, the disclosure of which is incorporated herein by reference.

BACKGROUND OF THE INVENTION

The present invention relates generally to semiconductor fabrication and, more specifically, to performing multiple wafer processing operations in a single wafer processing module using replaceable pad assemblies.

Fabrication of semiconductor devices involves wafer preparation and cleaning operations. Chemical mechanical planarization (CMP) operation is one of the wafer preparation operations designed to achieve global and local planarization of a wafer surface. Typically, the planarization of a wafer involves multiple CMP operations wherein various layers formed over the substrate surface are polished and planarized. A CMP system usually includes system components for handling and polishing the surface of a wafer. Such components can be, for example, a rotary polishing pad, an orbital polishing pad, or a linear belt polishing pad.

Generally, each different CMP operation requires specific consumables (e.g., polishing pad, slurry, etc.). A polishing pad, however, is attached to a polishing table in an orbital or rotary polishing pad. Thus, typical orbital or rotary CMP systems are considered to have rigid and inflexible configurations because the pad has to be ripped off of the polishing table causing polishing pad removal to be a labor intensive and time consuming task.

FIG. 1 is a simplified schematic diagram of a prior art wafer preparation and cleaning system. The system includes a wafer cassette 2 that holds unprocessed wafers, a plurality of modules 7–9 designed to perform different CMP operations, post CMP modules 6, and a wafer cassette 4 designed to receive and hold processed wafers. Each of the modules 7–9 performs different CMP operations in parallel. After each and every operation has completed, wafers are consecutively and simultaneously moved from the module 7, to the module 8, and from module 8 to module 9.

In FIG. 1, the module 7 performs a bulk removal CMP operation using a pad and slurry associated with the bulk removal CMP operation, module 8 performs the barrier removal using a pad and slurry associated with barrier removal, and the module 9 performs the buffing operation using a pad and slurry associated with the buffing operation. In short, usually, the pad materials and slurries are different depending on the CMP operation.

One shortcoming of the configuration shown in FIG. 1 is that because wafers should be transferred from one module to the next module simultaneously. In this manner, except in the slowest module, wafer processing in the remaining modules has to be elongated artificially. However, unless damage preventive measures are taken, artificially elongating wafer processing can result in corrosion and defective chips and thus wafer.

For instance, in the system shown in FIG. 1, each of the modules 7–9 can be programmed to process a corresponding wafer for one (1) minute. In this manner, performing all three CMP operations can take up to three (3) minutes.

However, in operation, module 7 may require 20 seconds to conduct the first CMP operation, module 8 requires 35 seconds to conduct the second CMP operation, and module 9 requires 50 seconds to conduct the third CMP operation. As a consequence, in operation, modules 7–9 are required to artificially elongate respective operations up to 50 seconds, the time required by the module 9 (e.g., the slowest module) to complete processing the wafer. As a consequence, three CMP operations which should have been conducted in 105 seconds, unnecessarily take about 150 seconds, with a needless delay of 45 (30+15) seconds.

Still further, CMP operations may have to be interrupted so that unqualified consumables can be changed. Halting the CMP tool and operation is undesirable because problems usually follow a discontinuity or change of consumables in the CMP operation.

In view of the foregoing, there is a need for a flexible single module apparatus capable of optimizing performance of multiple operations.

SUMMARY OF THE INVENTION

Broadly speaking, the present invention fills these needs by providing a single processing module capable of performing a multiple wafer preparation operations using replaceable pad assemblies. It should be appreciated that the present invention can be implemented in numerous ways, including as a process, an apparatus, a system, a device, or a method. Several inventive embodiments of the present invention are described below.

In accordance with a first aspect of the present invention, a table assembly for use in a wafer preparation module is provided. The table assembly includes a replaceable pad assembly and a permanent pad assembly. The replaceable pad assembly has a removable support element and a pad. A backside of the pad is secured to a front surface of the removable support element. The permanent support element is removeably secured to the replaceable pad assembly. In one embodiment, the removable support element is a thin sheet of a material comprised of metal. In one embodiment, the pad is comprised of polyurethane.

In accordance with a second aspect of the present invention, a method for conducting multiple wafer preparation operations in a single processing module is provided. In this method, a first wafer preparation operation using a first replaceable pad assembly is conducted. A second wafer preparation operation using a second replaceable pad assembly is also conducted.

In one embodiment, a third wafer preparation operation using a third replaceable pad assembly is also conducted. In one embodiment, the first wafer preparation operation, the second wafer preparation operation, and the third wafer preparation operations are chemical mechanical planarization (CMP) operations. In one embodiment, the first pad assembly includes a first pad secured to a first removable support element, the second pad assembly includes a second pad secured to a second removable pad support element, and the third pad assembly includes a third pad secured to a third removable pad support element. In one embodiment, conducting the first wafer preparation using the first pad includes supplying a first slurry onto the first pad. In one embodiment, conducting the second wafer preparation operation using the second replaceable pad assembly includes supplying a second slurry onto the second pad. The first slurry is different than the second slurry. In one embodiment, the first pad, the second pad, and the third pad are comprised of different pad materials. In one embodiment, the first removable support element is removed from over a permanent support element using a transport device.

In accordance with a third aspect of the present invention, a method for conducting multiple chemical mechanical planarization (CMP) operations in a single module is provided. A first pad assembly, a second pad assembly, and a third pad assembly are provided. The first pad is mounted on a first removable support element, a second pad is mounted on a second removable support element, and the third pad is mounted on a third removable support element. The first pad assembly is mounted onto a permanent support element and a first CMP operation is conducted using the first pad assembly. The first pad assembly is removed and the second pad assembly is mounted onto the permanent support element. A second CMP operation using the second pad assembly is conducted. The second pad assembly is removed and the third pad assembly is mounted onto the permanent support element. A third CMP operation using the third pad assembly is conducted.

In one embodiment, the first CMP operation, the second CMP operation, and the third CMP operation are different CMP operations. In one embodiment, the first CMP operation uses a first slurry, the second CMP operation uses a second slurry, and the third CMP operation uses a third slurry. At least one of the first slurry, the second slurry, and the third slurry is different than remaining slurries. In one embodiment, the first pad assembly, the second pad assembly, and the third pad assembly are obtained from a storage garage. In one embodiment, the storage garage holds a spare first pad assembly, a spare second pad assembly, and a spare third pad assembly. In one embodiment, the first pad assembly, the second pad assembly, and the third pad assembly are obtained from the storage garage using a transport device. In one embodiment, the single processing module includes either a rotary table assembly or an orbital table assembly.

In accordance with a fourth aspect of the present invention, a system for preparing a wafer is provided. The system includes a processing module, a storage garage, and a transport device. The processing module includes a wafer carrier that holds a wafer and a table assembly. The table assembly includes a replaceable pad assembly and a permanent support element. The replaceable pad assembly is removeably secured to the permanent support element. The storage garage stores a plurality of replaceable pad assemblies. The transport device transports the plurality of replaceable pad assemblies between the storage garage and the processing module.

In one embodiment, the system further includes a control unit that manages and monitors the operations of the storage garage, the transport device, and the processing module. In one embodiment, the storage garage stores a plurality of replaceable pad assemblies such that at least two of the plurality of replaceable pad assemblies are comprised of different pad materials.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE PREFERRED EMBODIMENTS

Figure 1:
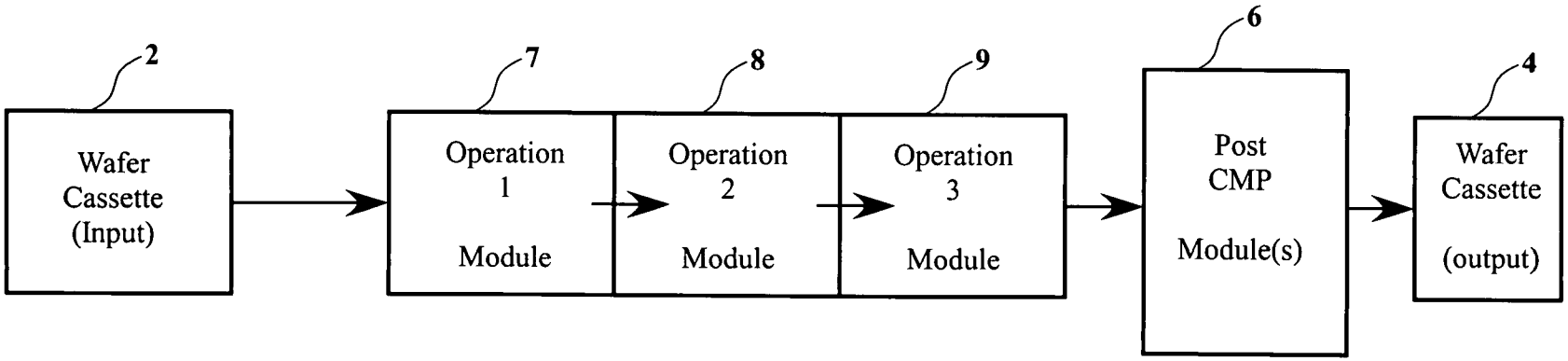
FIG. 1 (Prior Art)
FIG. 1 is a simplified schematic diagram of a wafer preparation and cleaning system.

Several exemplary embodiments of the invention will now be described in detail with reference to the accompanying drawings. FIG. 1 is discussed above in the "Background of the Invention" section.

Figure 2A:
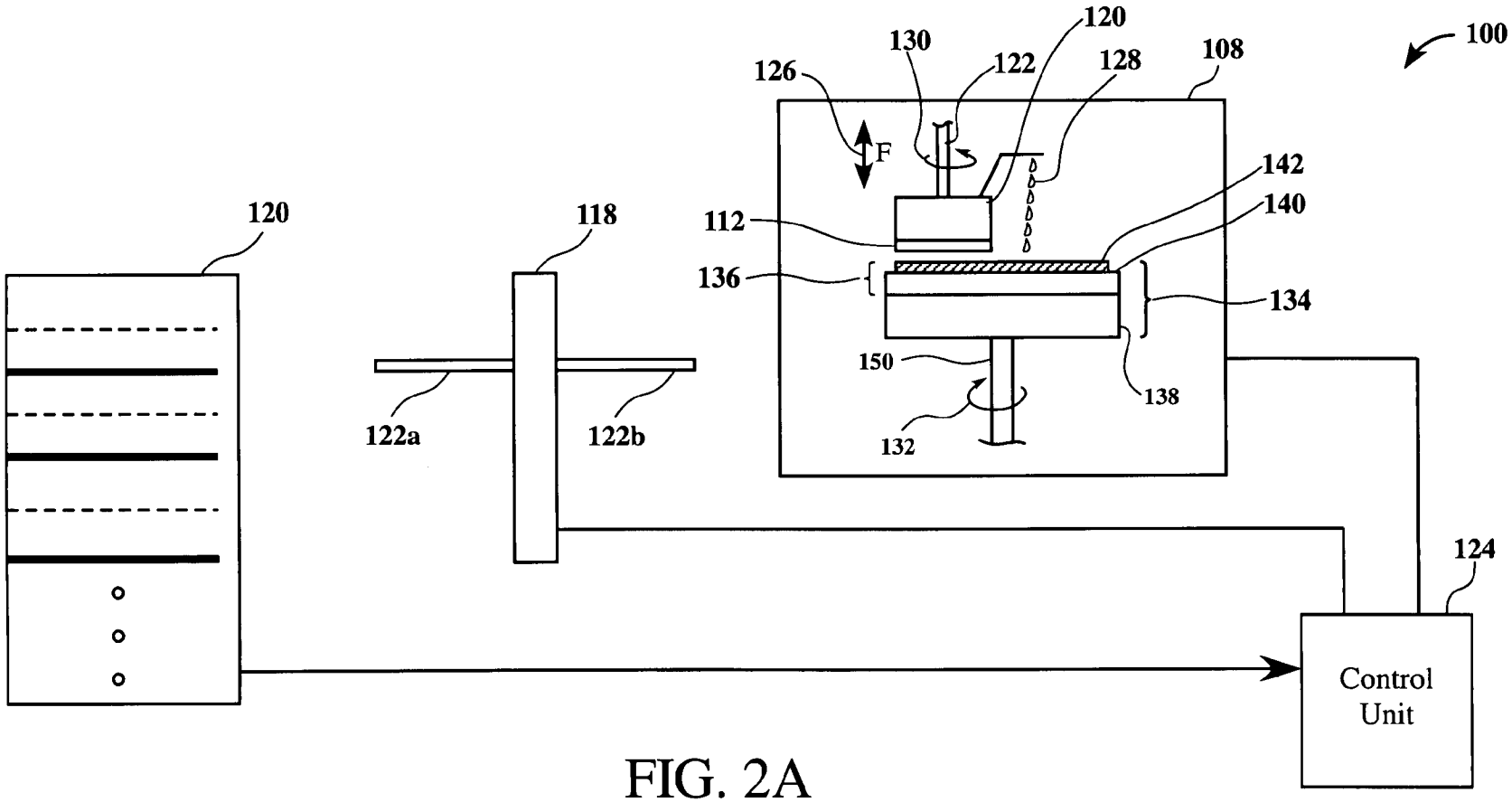
FIG. 2A is a simplified schematic diagram of a rotary chemical mechanical planarization (CMP) system using automatically replaceable polishing pad assemblies in accordance with one embodiment of the present invention.

FIG. 2A is a simplified schematic diagram of a rotary chemical mechanical planarization (CMP) system 100 using automatically replaceable polishing pad assemblies in accordance with one embodiment of the present invention. The CMP system includes a processing module 108, a robot 118, a storage garage 120, and a control unit 124. The processing module 108 includes a rotary table assembly 134 defined on a spindle 150 configured to be rotated in a direction 132. Further included in the processing module 108 is a wafer carrier head 120 secured to a shaft 122 configured to rotate in a direction 122. The wafer carrier head 120 is configured to apply a wafer 112 being held by the carrier head 120 onto the rotary table assembly 134 by a force 126. In the embodiment shown in FIG. 2A, slurry 128 is introduced onto the polishing interface through a nozzle 127 defined above the rotary table assembly 134. However, it must be noted that slurry 128 can be any suitable slurry and that slurry can be introduced onto the polishing interface by any appropriate technique (e.g., array of nozzles, array of nozzles in conjunction with dispense devices, etc.).

As can be seen, the rotary table assembly 134 includes a replaceable pad assembly 136 and a permanent support element 138. The replaceable pad assembly 136 in turn includes a polishing pad 142 secured to a removable support element 140. In one example, the polishing pad 142 is a polyurethane pad. It must be appreciated that the embodiments of the present invention can implement any appropriate type of polishing pad (e.g., fixed abrasive polishing pad, non-fixed abrasive polishing pad, etc.). Additional information with respect to the structure of the rotary table assembly 134 is provided below with respect to FIG. 2B.

The robot 118 is shown to include a first arm 122*a* and a second arm 122*b* and is configured to load and unload replaceable pad assembly 136 from and to the storage garage 120 to and from the processing module 108. In one embodiment, the operations of the processing module 108, the load and unload movements of the robot 118, and the storage garage are controlled and monitored by the control unit 124. Additional information with respect to the structure of the storage garage 120 is provided below with respect to FIG. 2C.

Figure 2B:
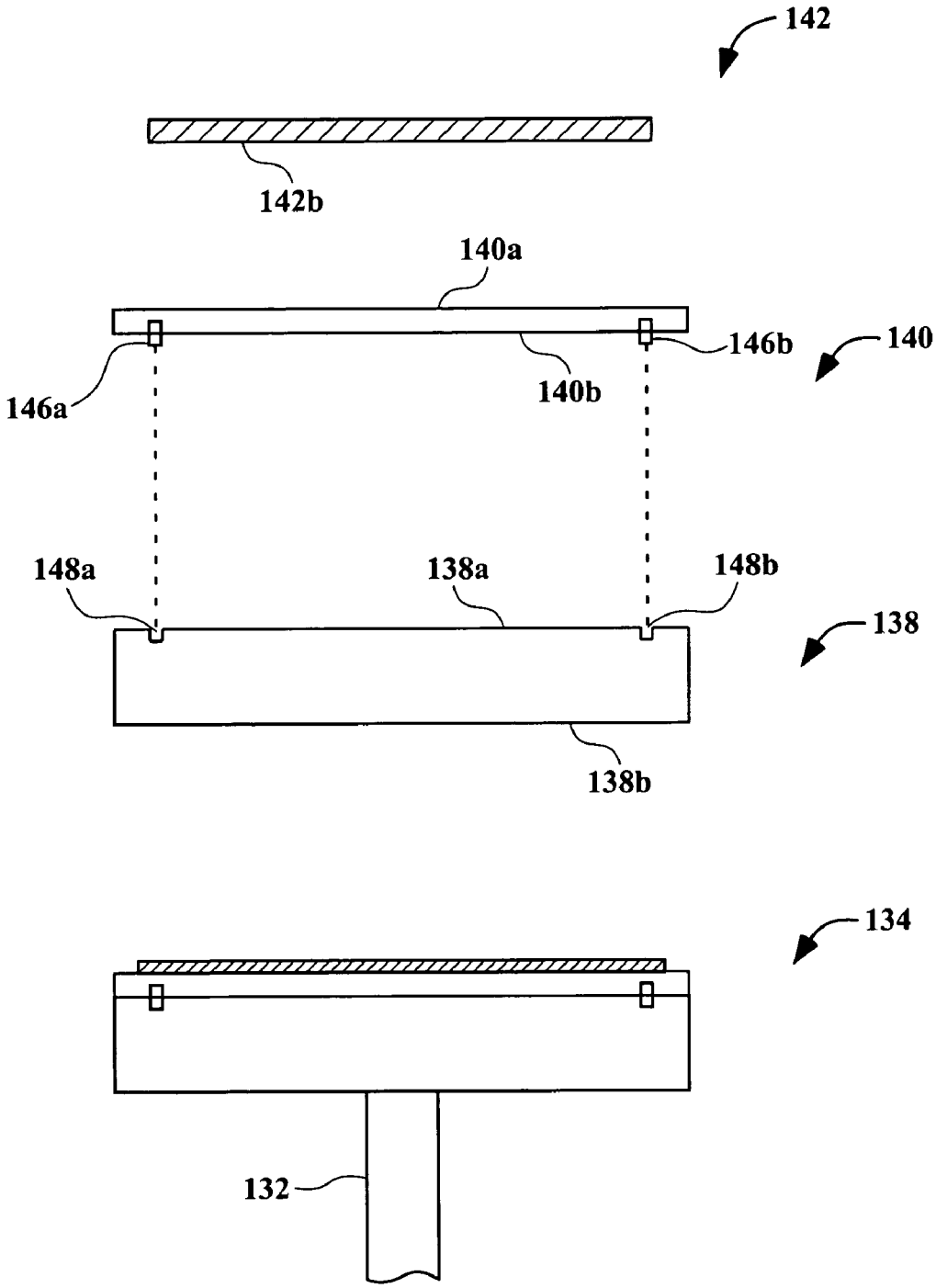
FIG. 2B is a simplified exploded diagram of a rotary table assembly in accordance with one embodiment of the invention.

FIG. 2B is a simplified exploded diagram of a rotary table assembly 134 in accordance with one embodiment of the present invention. As can be seen, a backside 142*b* of the polishing pad 142 is secured to a front surface 140*a* of the removable support element 140. According to one embodiment of the present invention, the removable support element 140 is a thin metal plate that is thick enough not to be disfigured while the polishing pad 142 is being mounted thereon and being transferred between the processing module 108 and the storage garage 120. One of ordinary skill in the art should appreciate that the polishing pad 142 can be secured to the removable support element 140 using any appropriate technique (e.g., adhesive, electromagnetic holder, etc.).

A back surface 140*b* of the removable support element 140 is secured to a front surface 138*a* of the permanent support element 138. In one embodiment, the permanent support element 138 is a metal disc that is configured to be thicker than the removable support element 140 so as to absorb force 126 being applied thereon during the wafer processing.

In the embodiment shown in FIG. 2B, the removable support element 140 has been secured to the permanent support element 138 using clamps 146*a* and 146*b* and receiving members 148*a* and 148*b*, respectively. However, one of ordinary skill in the art must appreciate that the back surface 140*b* of the removable support element 140 can be secured to the front surface 138*a* of the removable support element 140 using any appropriate technique (e.g., adhesive, magnet, etc.). In accordance with one embodiment, the thickness of the rotary table assembly 134 may be equivalent to a thickness of the rotary table of the prior art rotary system.

Figure 2C:
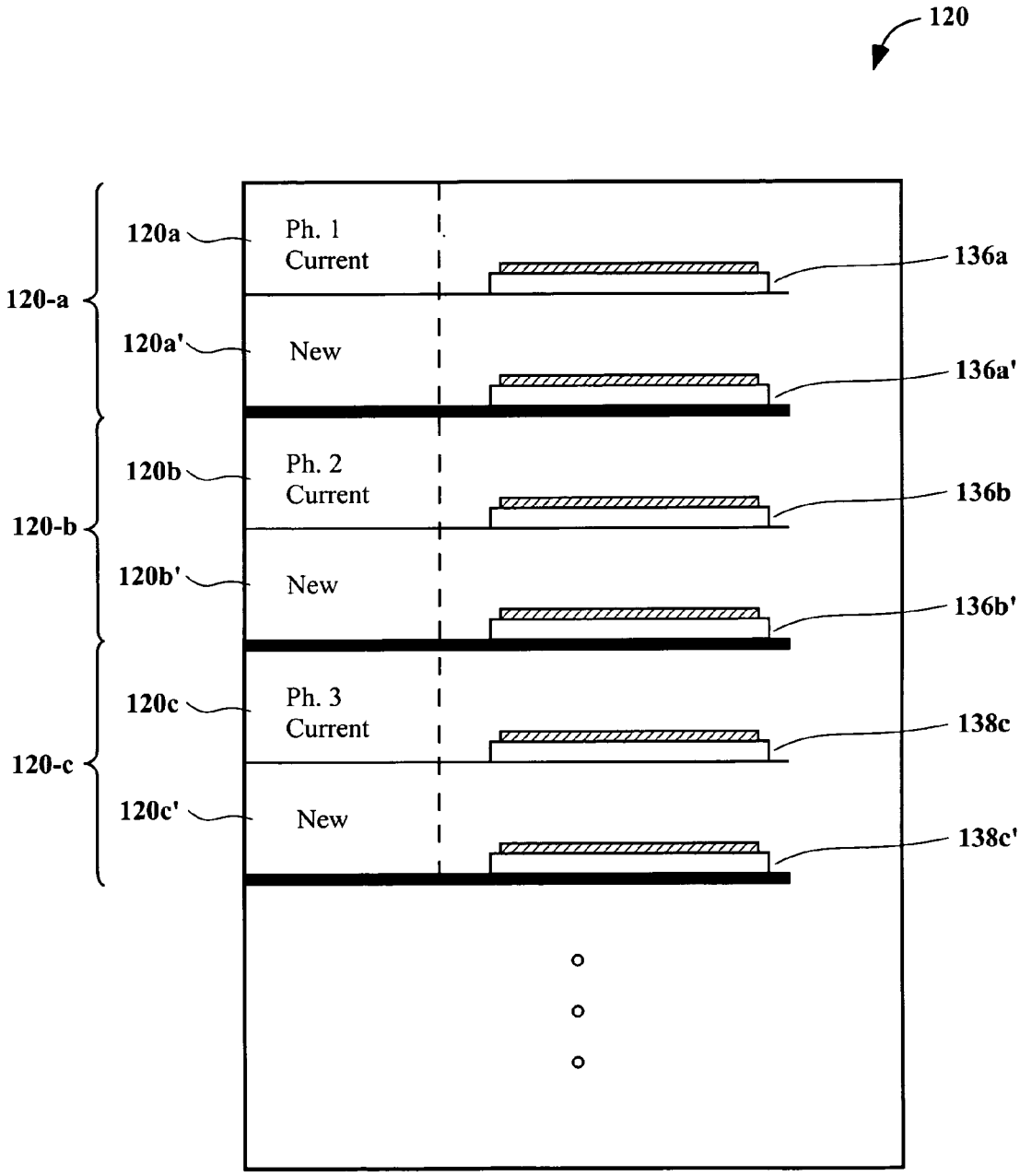
FIG. 2C is a simplified schematic diagram of a storage garage in accordance with one embodiment of the invention.

FIG. 2C is a simplified schematic diagram of an exemplary storage garage in accordance with one embodiment of the present invention. The storage garage 120 includes a plurality of compartments 120-*a*, 120-*b*, 120-*c*, etc. divided into partitions 120*a* and 120*a*', 120*b*, and 120*b*', 120*c*, and 120*c*', etc., respectively. Each compartment 120-*a*, 120-*b*, and 120-*c*, etc. corresponds to an associated operation of multiple wafer preparation operations to be conducted in the processing module 108.

As can be seen, each partition 120*a*, 120*b*, and 120*c*, etc. holds a corresponding current replaceable pad assembly 136*a*, 136*b*, 136*c*, etc. Similarly, each partition 120*a*', 120*b*', 120*c*', etc. holds a corresponding new replaceable pad assembly 136*a*', 136*b*', 136*c*', etc. That is, a first operation current replaceable pad assembly 136*a* is held in the partition 120*a* while a first operation new replaceable pad assembly 136*a*' is held in the partition 120*a*'. In the same manner, a second operation current replaceable pad assembly 136*b* is held in the partition 120*b* while a second operation new replaceable pad assembly 136*b*' is held in the partition 120*b*', and a third operation current replaceable pad assembly 136*c* is held in the partition 120*c* while a third operation new replaceable pad assembly 136*c*' is held in the partition 120*c*'.

As will be explained in more detail below, each operation of the multiple wafer preparation operations is conducted within the processing module 108 using a corresponding current replaceable pad assembly using the consumables required for performing the respective operation. In this manner, a single processing module can be implemented to perform multiple CMP operations.

In accordance with a preferred embodiment, the ready to use polishing pads associated with each operation are stored in the storage garage 120. Additionally, the storage garage 120 includes a plurality of vacancies for pads associated with each of the operations. In one example, after securing the pad to the replaceable pad assemblies, the pads are qualified by the technicians outside of the CMP system. In one example, the storage garage 120 can be automated so as to further facilitate and expedite the performance of multiple wafer preparation operations. Still further, in a different embodiment, multiple storage garages can be used with each storage garage configured to store replaceable pad assemblies for an associated operation. Yet further, in one example, multiple robots can be implemented to load and unload replaceable pad assemblies.

For instance, the first, second, and third operations can be different CMP operations such that the first operation can include topography planarization and bulk removal, the second operation can include clearance of remaining overburden copper to barrier, and the third operation can include barrier CMP and final surface finish (i.e., buffing).

Figure 3A:
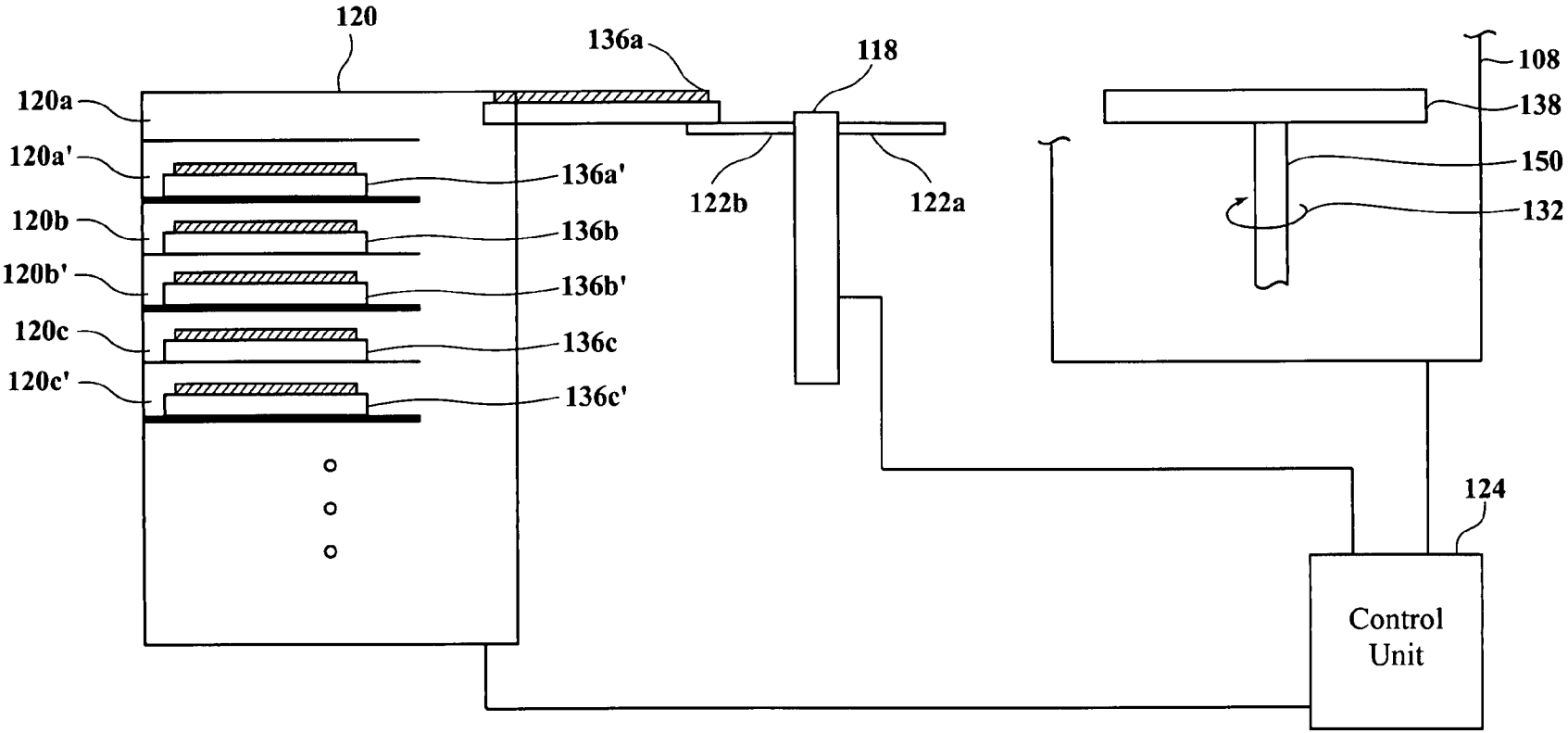
FIG. 3A is simplified schematic cross sectional view of a CMP system implementing a single rotary CMP processing module using automatically replaceable polishing pad assemblies depicting the transport of a first operation current replaceable pad assembly accordance with one embodiment of the invention.

FIGS. 3A–3D are simplified schematic cross sectional view of a CMP system implementing a single rotary CMP processing module 108 using automatically replaceable polishing pad assemblies in accordance with one embodiment of the present invention. FIG. 3A depicts the initiation of the first CMP operation wherein the first operation current replaceable pad assembly 136*a* is captured by the robot arm 122*b* and is transported to the processing module 108. In one example, the first CMP operation is initiated by the control unit 124 that manages, monitors, and maintains operations of the processing module 108, the robot 118, and the storage garage 120. In the embodiment shown in FIG. 3A, in one example, the control unit 124 issues a command to the robot 118 announcing the commencement of the first CMP operation. Upon receiving such command, the robot 118 is guided to the partition 120*a* of the storage garage 120 designed to hold the first operation current replaceable pad assembly 136*a*.

As can be seen, the embodiments of the present invention are shown to automatically load, transport, and unload the replaceable pad assemblies 136 using a robot 118 having two arms 122*a* and 122*b*. However, it must be appreciated by one of ordinary skill in the art that including two arms 122*a* and 122*b* in the robot 118 is merely an example. That is, the embodiments of the present invention can include a robot having none, one, or multiple arms. Furthermore, each of the arms can be configured to include one or more fingers. Still further, the robot 118 as well as the arms 122*a* and 122*b* can be configured to perform any movement necessary to grip, load, transport, unload, and deliver the replaceable pad assemblies 136. Additionally, one must appreciate that the replaceable pad assembly 136 can be held by the arms 122*b* and 122*a* using any appropriate technique (e.g., suction, clamps, electromagnetic holders, etc.). Still further, in addition to the robot 118, the replaceable pad assembly 136 can be transported, loaded, and unloaded to and from the storage garage to and from the processing module 108 using any appropriate mechanics and technique (e.g., manual special devices, robot-assisted devices, etc.).

Figure 3B:
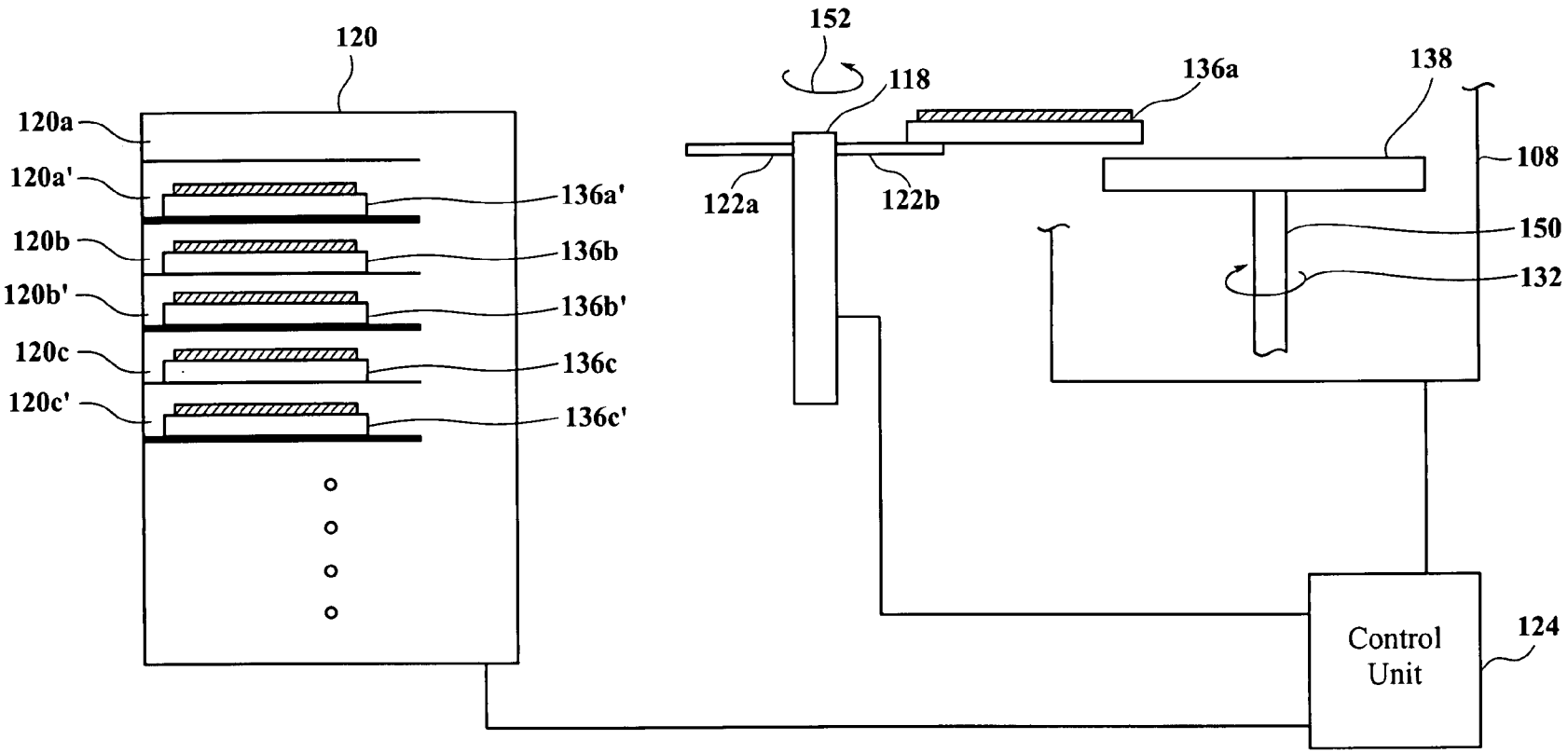
FIG. 3B is simplified schematic cross sectional view of the CMP system implementing a single rotary CMP processing module using automatically replaceable polishing pad assemblies depicting the unloading of the first operation current replaceable pad assembly in accordance with one embodiment of the invention.

FIG. 3B shows that the first operation current replaceable pad assembly 136*a* has been transported from the partition 120*a* and is about to be delivered onto the permanent support element 138 defined in the processing module 108. As can be seen, in this embodiment, to transport the first operation current replaceable pad assembly 136*a*, the arm 122*b* of the robot 118 has been rotated in the direction 152 for about 180 degrees. In this manner, the first CMP operation can be performed using the appropriate polishing pad as well as slurry in a single processing module 108 for only the extent of time necessary to complete the first CMP operation.

Figure 3C:
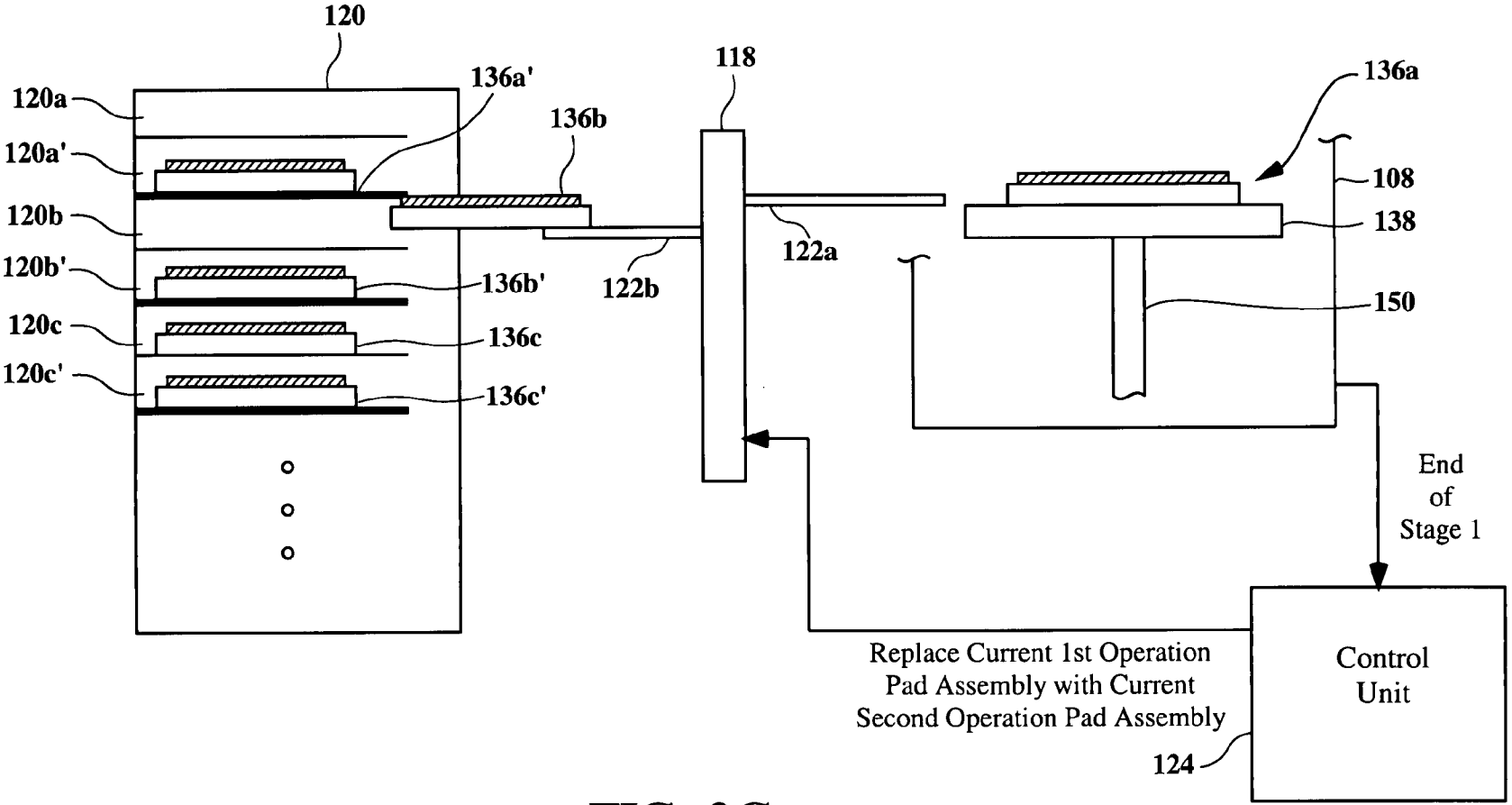
FIG. 3C is simplified schematic cross sectional view of the CMP system implementing a single rotary CMP processing module using automatically replaceable polishing pad assemblies depicting the transport of a second operation current replaceable pad assembly to the processing module and unloading of the first operation current replaceable pad assembly in accordance with one embodiment of the invention.

FIG. 3C depicts the state of the CMP system at the conclusion of the first CMP operation in accordance with one embodiment. As can be seen, while the first operation current replaceable pad assembly 136*a* is still secured to the permanent support element 138, a message is communicated to the control unit 124 signaling the end of the first CMP operation. At this point, in one example, the control unit 124 issues a command to the robot 118 instructing the robot 118 to capture the second operation current replaceable pad assembly 136*b*. As can be seen, the robot 118 has grabbed the second operation current replaceable pad assembly 136 using the arm 122*b*. Meanwhile, the arm 122*a* of the robot 118 can be used to capture and unload the first operation current replaceable pad assembly 136*a* so as to transport the assembly 136*a* to the appropriate partition of the storage garage 120 for future use. In one exemplary embodiment, at this juncture, if needed, the surface of the wafer being processed, the top of the permanent pad, or any other component in the processing module can be rinsed using any appropriate fluid (e.g., de-ionized water, chemical solutions containing cleaning and corrosion inhibiting materials, etc.).

Figure 3D:
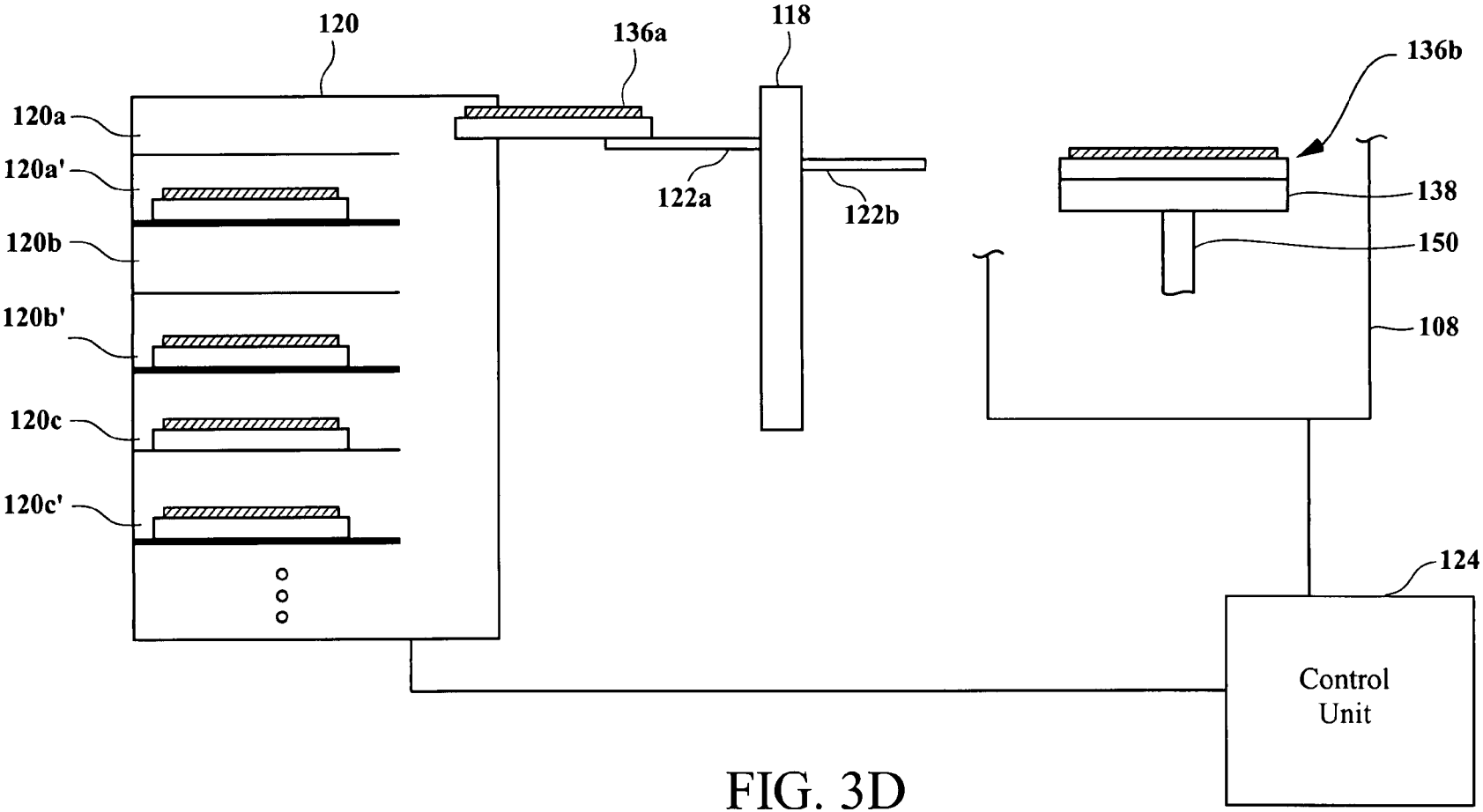
FIG. 3D is simplified schematic cross sectional view of the CMP system implementing a single rotary CMP processing module using automatically replaceable polishing pad assemblies depicting the unloading of the first operation current replaceable pad assembly to the storage garage in accordance with one embodiment of the invention.

FIG. 3D depicts the state of the CMP system wherein the second current operation replaceable pad assembly 136*b* has been loaded onto the permanent support element 138 and the first operation replaceable component 136*a* is being transported back to the partition 120*a* of the storage garage 120. As can be seen, to deliver respective replaceable pad assemblies 136*b* and 136*a*, arms 122*b* and 122*a* have rotated 180 degrees.

At this point, the second operation of the CMP process is commenced and the wafer is processed only for the necessary extent of time required to conduct the second operation. Thereafter, as previously described above, the replaceable pad assemblies are consecutively changed until each and every CMP operation is performed in the single processing module 108 using the applicable replaceable pad assembly and for the time necessary to perform each CMP operation.

As can be appreciated, the embodiments of the present invention are capable of performing infinite number of wafer preparation operations in a single module by replacing the consumables (e.g., the replaceable pad assemblies, slurry, etc.).

In accordance with one example, exchanging of a replaceable pad assembly may take approximately between 5 and 10 seconds. As a result, by processing the wafer for the amount of time required for each CMP operation, the embodiments of the present invention increase the productivity of the CMP system. That is, in contrast to the prior art, a need does not exist to artificially elongate a CMP operation being processed in the single module. Yet further, as multiple wafer preparation operations can be performed in a single processing module, the embodiments of the present invention are more flexible than the prior art CMP systems and tools.

Figure 4:
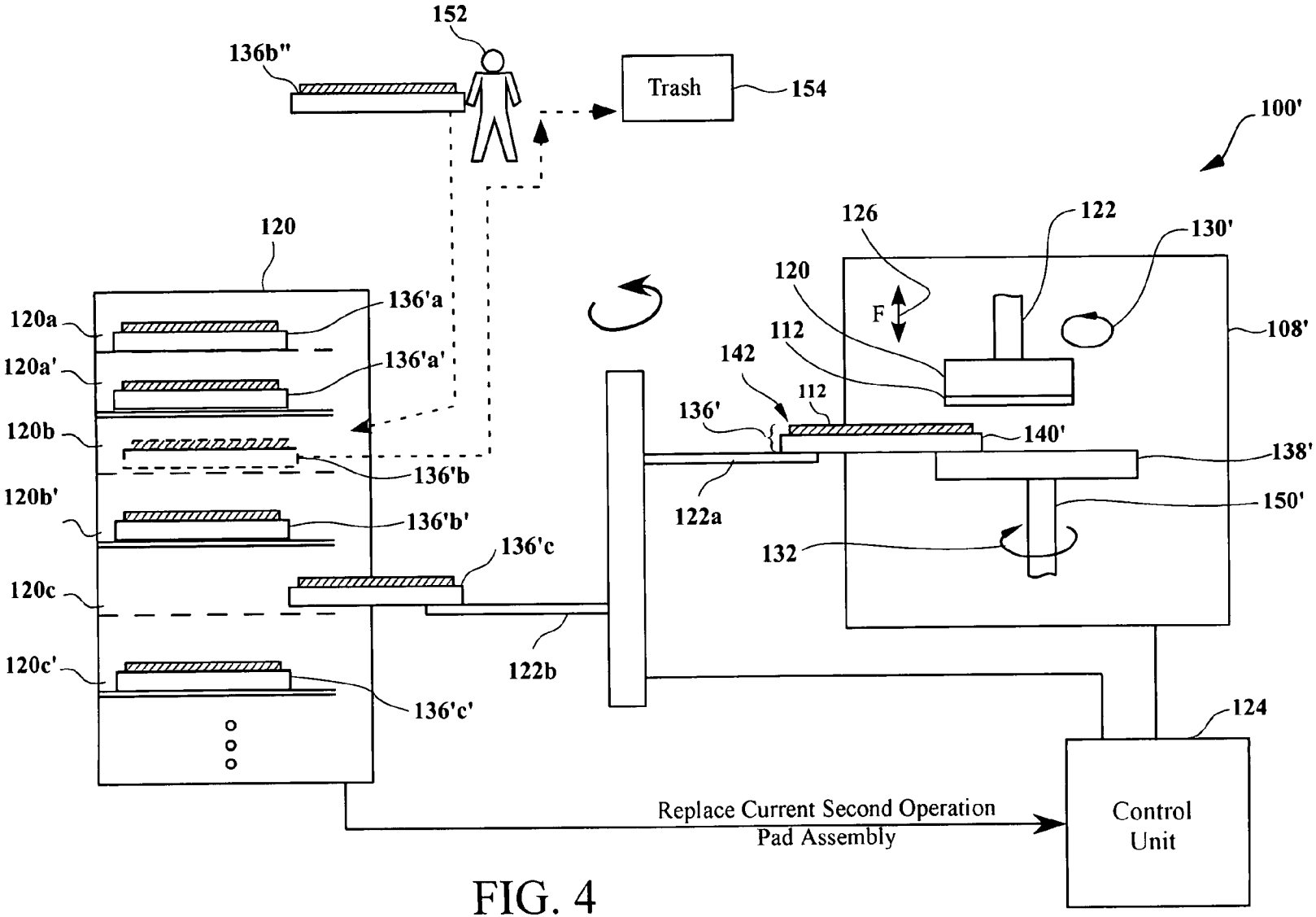
FIG. 4 is a simplified schematic diagram of an orbital CMP system in accordance with one embodiment of the invention.

FIG. 4 is a simplified schematic cross sectional view of an exemplary orbital CMP system 100' using replaceable pad assemblies in accordance with one embodiment of the present invention. As can be seen, the orbital CMP system 100' includes a processing module 108', the robot 118, the storage garage 120, and a control unit 124. The processing module 108' includes an orbital table assembly defined on a spindle 150' configured to be rotated in a direction 150. Also included in the processing module 108' is a wafer carrier head 120 that is secured to a shaft 122 configured to rotate in a direction 122. The wafer carrier head 120 is configured to apply the wafer 112 onto the orbital table assembly by a force 126 while orbiting at a direction 130'.

In the embodiment shown in FIG. 4, slurry is introduced onto the polishing interface through a permanent support element 138'. For instance, slurry can be introduced through a plurality of holes defined in the permanent support element 138'. However, in a different embodiment, slurry 128 can be introduced onto the polishing interface by any appropriate technique.

As can be seen, the orbital table assembly includes a replaceable pad assembly 136' and a permanent support element 138'. The replaceable pad assembly 136' in turn includes a polishing pad 142' secured to a removable support element 140'. In the illustrated embodiment, the permanent support element 138' and the replaceable pad assembly 136' can be configured to have a larger diameter than the permanent support element 138 and replaceable pad assembly 136 of the rotary CMP system.

The state of the orbital CMP system 100' shown in FIG. 4 is at the commencement of the third CMP operation. As can be seen, the third operation current replaceable pad assembly 136'c is being captured from the partition 120*c* of the storage garage 120 by the arm 122*b* of the robot 118 while the second operation current replaceable pad assembly 136'b is being unloaded by the arm 122*a* from the processing module 108'. At this point, the arms 122*a* and 122*b* rotate about 180 degrees so as to unload respective current replaceable pad assemblies 136'b and 136'c to the storage garage 120 and the processing module 108', correspondingly. Once the third operation current replaceable pad 136'c is loaded onto the permanent support element 138' and is secured, the third operation of the CMP operation is initiated and conducted.

While the processing module 108 is performing the third CMP operation, the storage garage 120 issues a command to the control unit 124 signaling that the just unloaded second operation current replaceable pad assembly 136'b is no longer qualified to be used and that should be replaced.

Upon receiving such command, the control unit 124 issues a warning, requesting that the second operation current replaceable pad assembly to be replaced. In one exemplary embodiment, at this point, the old second operation current replaceable pad assembly 136*b* is replaced by a second operation new current replaceable pad assembly 136"c" by a technician 152. In one example, the old second operation current replaceable pad assembly 136'b is discarded in a trash 154. In another example, the polishing pad 142' can be ripped from over the removable support element 140' and be discarded while the removable support element 140' can be reused.

As can be appreciated, due to the easily replaceable and transferable nature of the replaceable pad assembly of the present invention, a used pad assembly can be replaced by a new replaceable pad assembly without placing the CMP system on hold or significantly interrupting the CMP process. By way of example, if a need arises to replace a second operation replaceable pad assembly while the old second operation current replaceable pad assembly is being replaced, the robot is configured to capture and transport the second operation new replaceable pad assembly 136'b' held at partition 120*b*' of the storage garage 120 until the second operation current pad assembly is replaced.

Accordingly, the embodiments of the present invention can perform multiple wafer preparation operations in a single module using replaceable pad assemblies without having a need to interrupt the CMP operations for a significant period of time to change unqualified consumables.

Of course, in a different embodiment, a plurality of single processing modules can be used in parallel to process multiple wafers simultaneously using the replaceable pad assemblies of the present invention. In such scenario, each single processing module of the plurality of single processing modules can conduct multiple CMP operation on the same wafer without having a need to perform any intermediate operations to clean the module and/or the pad. In such scenario, each processing module can be configured to interact with a respective storage garage or a respective single storage garage each of which can include multiple vacancies and replaceable pad assemblies.

Figure 5:
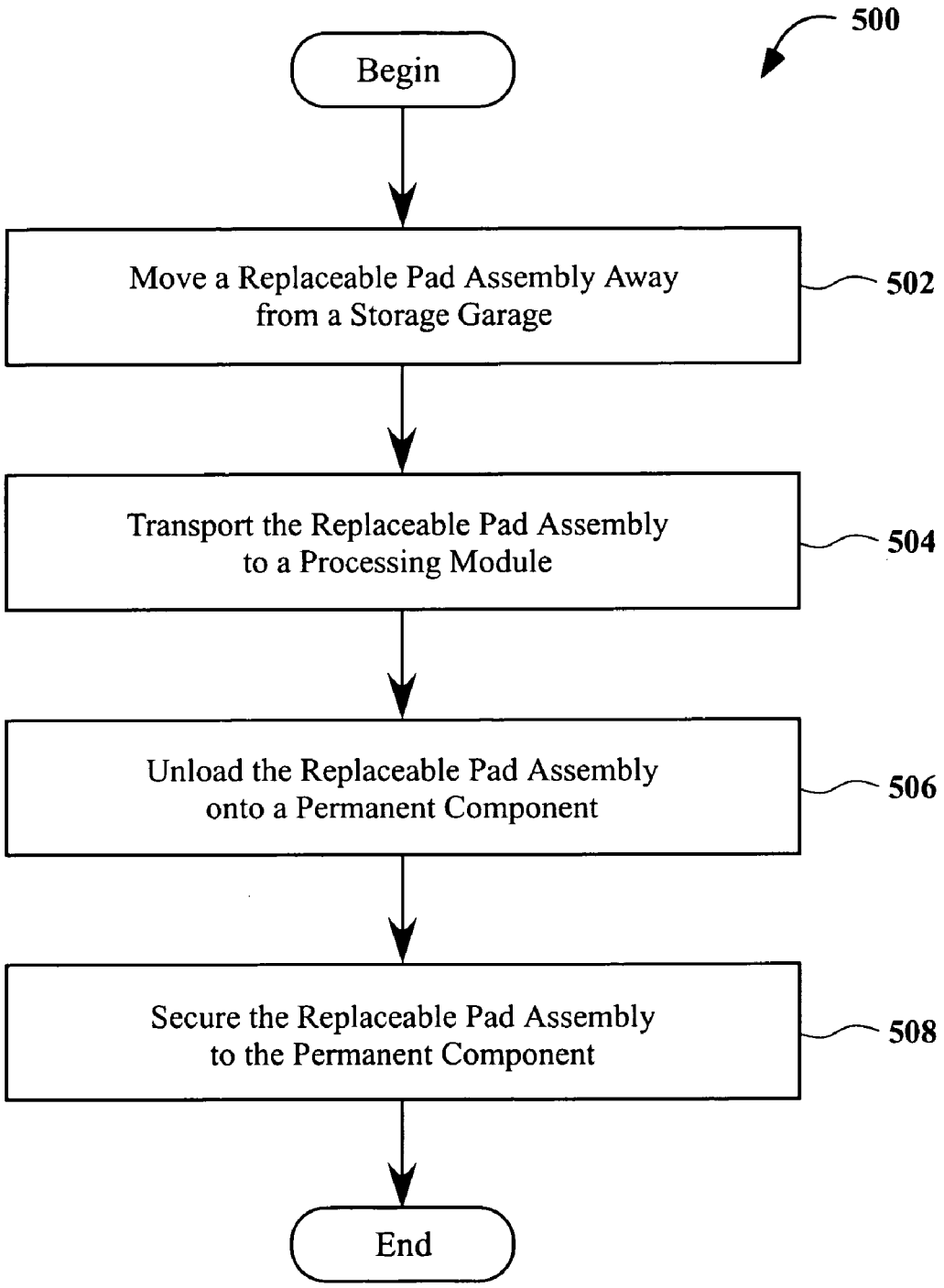
FIG. 5 is a flowchart diagram of method operations performed in using a single processing module to perform multiple operations in accordance with one embodiment of the present invention.

Reference is made to the flowchart diagram 500 depicted in FIG. 5 of method operations performed in using a single processing module to perform multiple wafer preparation operations in accordance with one embodiment of the present invention. The method begins in operation 502 in which a replaceable pad assembly is moved away from a storage garage. In one example, a plurality of replaceable pad assemblies associated with different operations is stored to the storage garage. According to one embodiment, the replaceable pad assembly is captured and moved by a robot. Next, in operation 504, the replaceable pad assembly is transported to the processing module.

Proceeding to operation 506, the replaceable pad assembly is unloaded onto a permanent support element of the table assembly. In one example, the table assembly can be a rotary table assembly or an orbital table assembly. Next, in operation 508, the replaceable pad assembly is secured to the permanent support element. In one example, the replaceable pad assembly can be clamped to the permanent support element.

Figure 6:
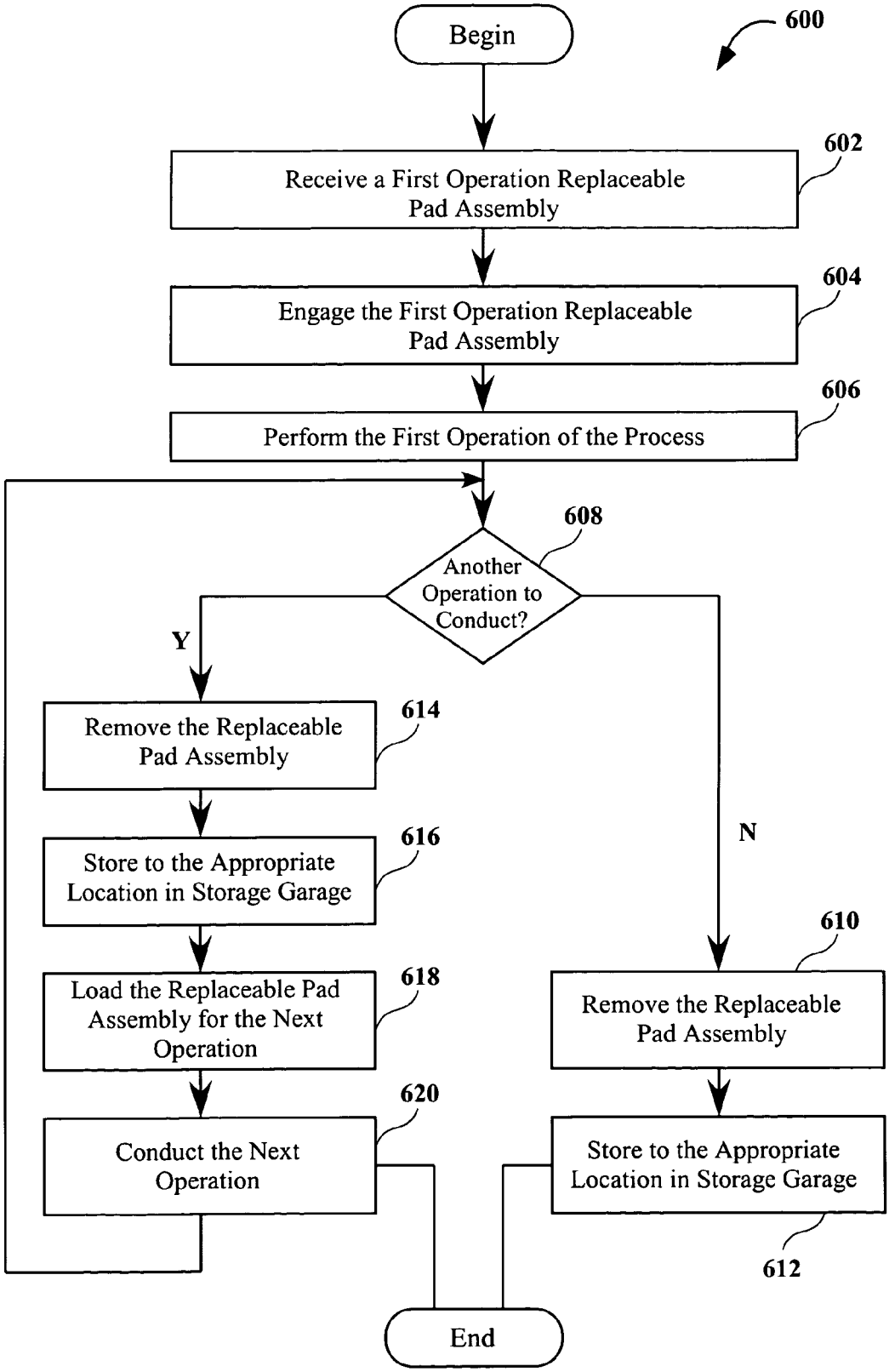
FIG. 6 is a flowchart diagram of method operations performed in using a single processing module to perform multiple operation in accordance with one embodiment of the present invention.

FIG. 6 depicts the flowchart diagram 600 of method operations performed to conduct multiple operations in a single processing module in accordance with one embodiment of the present invention. The method begins in operation 602 in which a first operation replaceable pad assembly is received followed by engaging the first operation replaceable pad assembly in operation 604. Thereafter, in operation 606, the first operation is conducted. In one example wherein multiple CMP operations are being performed, slurry associated with first CMP operation is introduced into the processing module.

In operation 608, a determination is made as to whether another operation should be conducted. If a determination is made that another operation to be conducted does not exist, the method continues to operation 610 wherein the replaceable pad assembly is removed from the processing module followed by operation 612 in which the replaceable pad assembly is stored to the appropriate location in the storage garage.

However, if another operation to be conducted exists, the method continues to operation 614 in which the replaceable pad assembly is removed from the processing module and is thereafter stored to the appropriate location in the storage garage in operation 616. Next, in operation 618, the replaceable pad assembly for the next operation is loaded into the processing module followed by operation 620 in which the next operation is conducted. Then, the method continues to operation 608 in which a determination is made as to whether another operation to be processed exists.

In summary, the present invention provides for the performance of an infinite number of wafer preparation operations in a single processing module using replaceable pad assemblies each associated with an operation. Each replaceable pad assembly includes a pad secured to a removable support element configured to be planted onto the permanent support element of a table defined in the processing module. The replaceable pad assemblies are stored in a storage garage and can be replaced when are no longer qualified for use.

Although the foregoing invention has been described in some detail for purposes of clarity of understanding, it will be apparent that certain changes and modifications may be practiced within the scope of the appended claims. It should be appreciated that while the embodiments have been described in terms of a CMP process, the single processing module, the replaceable pad assembly, and the storage garage of the present invention are not limited to a CMP process. For example, the single processing module, the replaceable pad assembly, and storage garage can be used for any semiconductor process that removes a layer or film on a substrate. Furthermore, the embodiments of the present invention can be implemented to process any substrate having varying sizes and shapes such as those employed in the manufacture of semiconductor devices, flat panel displays, hard drive discs, flat panel displays, and the like. Additionally, the present embodiments are to be considered as illustrative and not restrictive, and the invention is not to be limited to the details given herein, but may be modified within the scope and equivalents of the appended claims.

What is claimed is:

1. A method for conducting wafer preparation operations in a single processing module, the method comprising:

conducting a first wafer preparation operation using a first replaceable pad assembly having a first removable support element and a first pad, the conducting of the first wafer preparation operation including, supplying a first slurry onto the first pad; and conducting a second wafer preparation operation using a second replaceable pad assembly having a second removable support element and a second pad, the conducting of the second wafer preparation operation including, supplying a second slurry onto the second pad, wherein the first slurry is different than the second slurry.

2. A method as recited in claim 1, the method further comprising:

conducting a third wafer preparation operation using a third replaceable pad assembly having a third removable support element and a third pad.

3. A method as recited in claim 2, wherein the first wafer preparation operation, the second wafer preparation operation, and the third wafer preparation operations are chemical mechanical planarization (CMP) operations.

4. A method as recited in claim 2, wherein the first pad is secured to the first removable support element, the second pad is secured to the second removable support element, and the third pad is secured to the third removable support element.

5. A method as recited in claim 4, wherein the first pad, the second pad, and the third pad are comprised of different pad materials.

6. A method as recited in claim 1, wherein the first removable support element is removed from over a permanent support element using a transport device.

7. A method for conducting multiple chemical mechanical planarization (CMP) operations in a single module, the method comprising:

providing a first pad assembly, a second pad assembly, and a third pad assembly, the first pad assembly having a first pad mounted on a first removable support element, the second pad assembly having a second pad mounted on a second removable support element, and the third pad assembly having a third pad mounted on a third removable support element;

mounting the first pad assembly onto a permanent support element;

conducting a first CMP operation using the first pad assembly;

removing the first pad assembly;

mounting the second pad assembly onto the permanent support element;

conducting a second CMP operation using the second pad assembly;

removing the second pad assembly;

mounting the third pad assembly onto the permanent support element; and conducting a third CMP operation using the third pad assembly.

8. A method as recited in claim 7, wherein the first CMP operation, the second CMP operation, and the third CMP operation are different CMP operations.

9. A method as recited in claim 7, wherein the first CMP operation uses a first slurry, the second CMP operation uses a second slurry, and the third CMP operation uses a third slurry and wherein at least one of the first slurry, the second slurry, and the third slurry is different than remaining slurries.

10. A method as recited in claim 7, wherein the first pad assembly, the second pad assembly, and the third pad assembly are obtained from a storage garage.

11. A method as recited in claim 10, wherein the storage garage holds a spare first pad assembly, a spare second pad assembly, and a spare third pad assembly.

12. A method as recited in claim 10, wherein the first pad assembly, the second pad assembly, and the third pad assembly are obtained from the storage garage using a transport device.

13. A method as recited in claim 12, wherein the single processing module includes one of a rotary table assembly and an orbital table assembly.

* * * * *